United States Patent [19]

Goodman et al.

[11] 4,026,623

[45] May 31, 1977

[54] ZERO FORCE CONNECTOR

[75] Inventors: David S. Goodman, Mission Viejo; Leslie M. Borsuk, Los Alamitos, both of Calif.

[73] Assignee: International Telephone and Telegraph Corporation, New York, N.Y.

[22] Filed: Mar. 8, 1976

[21] Appl. No.: 664,994

[52] U.S. Cl. ..... 339/75 M; 339/91 R

[51] Int. Cl.² ..... H01R 13/54

[58] Field of Search ..... 339/75 R, 75 M, 75 MP, 339/79 R, 176 M

[56] References Cited

UNITED STATES PATENTS 3,587,031 6/1971 Flavin et al. ..... 339/75 MP

OTHER PUBLICATIONS

IBM Technical Disclosure Bulletin, vol. 9, No. 3, 8–1966, p. 254, Cammed Connector, Uberbacher.

IBM Technical Disclosure Bulletin, vol. 17, No. 1, 6–1974, pp. 138–139, Cam Actuated, Force Free Connector with Contact Springs, Branson et al.

*Primary Examiner*—Roy Lake
*Assistant Examiner*—E. F. Desmond
*Attorney, Agent, or Firm*—Thomas L. Peterson

[57] ABSTRACT

An electrical connector having a zero insertion force upon mating of a first connector member and a second connector member. Each of the connector members contains contacts mounted in bores formed therein. The contacts in one of the connector members extend forwardly from the bores. A split insulator member in such connector member forms a pair of actuating plates. A rotatable actuating shaft is disposed between the plates and carries an actuating cam which, when the shaft is rotated, shifts the actuating plates apart to mate the contacting surfaces of the contacts in the respective connector members. The actuating shaft carries a pin at its forward end which cooperates with an inclined ramp in the second connector member to cause the connector members to shift axially relative to each other upon actuation of the movable contacts thereby producing an axial wiping engagement between the associated contacts in the two connector members.

8 Claims, 8 Drawing Figures

FIG.6
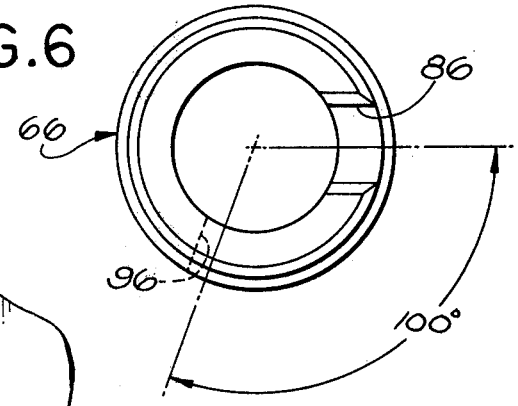
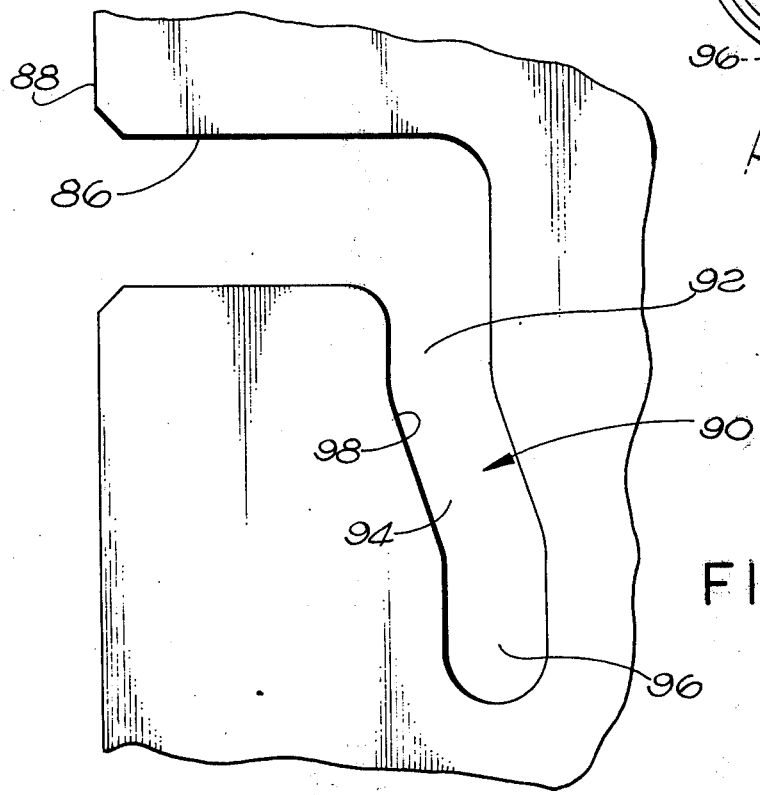
FIG. 7
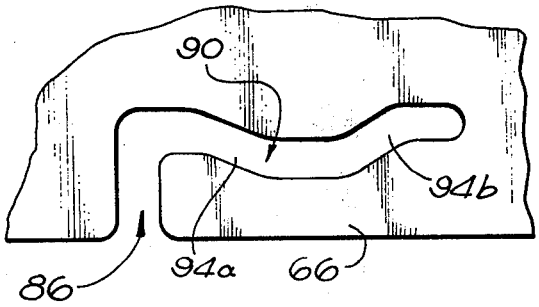
FIG. 8

ZERO FORCE CONNECTOR

BACKGROUND OF THE INVENTION

The present invention relates generally to an electrical connector and, more particularly, to an improved zero insertion force electrical connector.

The present invention comprises an improvement upon the zero force connector disclosed in U.S. Pat. No. 3,594,698 to Anhalt, assigned to the assignee of the present application. Such connector contains fixed contacts in one connector member and movable contacts in the mating connector member. A split insulator member is provided in the second connector member forming a pair of actuating plates for the movable contacts. A cam shaft is rotatably mounted between the actuating plates in the second connector member. Rotation of the shaft causes the actuating plates to be shifted in opposite directions, thereby moving the movable contacts into electrical engagement with the fixed contacts in the first connector member.

The movable contacts in the aforementioned Anhalt connector have elongated spring beam sections with contacting surfaces at the ends of the beams. The actuating plates engage the spring beams at points spaced behind the contacting surfaces of the contacts so that the beams flex or "bow" when the actuating plates are shifted by the cam shaft. This flexing of the contacts causes a wiping engagement to be produced between the contacting surfaces of the mating contacts, thereby enhancing the electrical engagement made between the contacts. While this wiping engagement is normally satisfactory to provide reliable electrical connection, for some applications, such as when the connector is exposed to heavy dust laden environments, a greater wiping engagement is required between the contacts. The purpose of the present invention is to provide an improved zero insertion force electrical connector in which increased wiping engagement is produced between the contacts of the mating connector halves of the connector assembly.

SUMMARY OF THE INVENTION

According to the principal aspects of the present invention, there is provided a zero insertion force electrical connector comprising a first connector member having a first set of contacts and a second connector member having a second set of contacts, each associated with one of the contacts of the first connector member. The associated contacts of the first and second sets of contacts are positioned laterally adjacent to but spaced from each other when the connector members are mated. Thus, the connector members may be mated with essentially zero insertion force. Means is provided for laterally moving the contacts in one connector member simultaneously to engage the contacts in the mating connector member. Additional means is incorporated into the connector for shifting the connector members axially relative to each other to cause an axial wiping engagement between the associated contacts of the first and second set of contacts. Such axial wiping engagement between associated contacts assured reliable electrical connection therebetween, even in highly contaminated environments.

BRIEF DESCRIPTION OF THE DRAWINGS

FIG. 6 is a front end view of the bushing illustrated in FIG. 5;

FIG. 7 is a fragmentary developed view of the bushing illustrated in FIGS. 5 and 6 showing the configuration of the slot therein; and FIG. 8 is a developed view similar to FIG. 7 showing a modified configuration of the slot which may be utilized in the bushing illustrated in FIG. 5.

DESCRIPTION OF THE PREFERRED EMBODIMENTS

Figure 1:
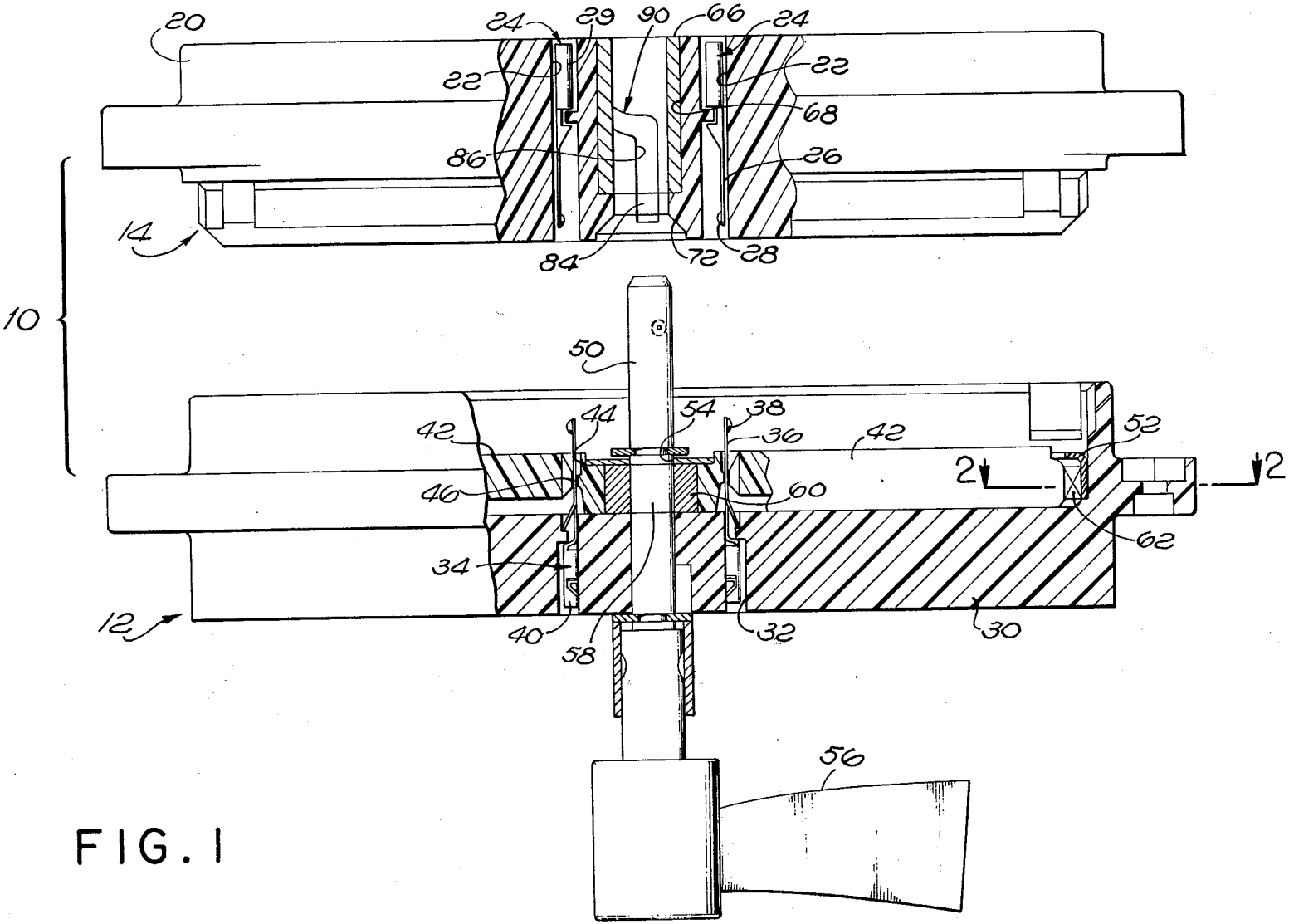
FIG. 1 is an exploded view, partly in section, of the connector assembly of the present invention showing the mating plug and receptacle connector members disengaged.

Referring now to the drawings in detail, there is illustrated the zero insertion force electrical connector of the present invention, generally designated 10. The connector comprises a plug connector member 12 and a mating receptacle connector member 14.

The receptacle connector member 14 comprises an insulator 20 formed with a plurality of openings 22 which extend lengthwise between the front and rear faces of the insulator. Each opening contains an individual contact 24. The contact has a forward portion 26 which lies against the side of the opening 22. Thus, the contact 24 is a fixed contact. A contacting surface 28 is formed on the end of the forward portion 26, facing into the interior of the opening. Each contact terminates in a terminal portion 29, which may be connected to a wire, not shown.

The plug connector member 12 also comprises a fixed insulator 30 formed with a plurality of openings 32 which extend lengthwise therethrough and are aligned with the openings 22 in the connector member 14 when the plug and receptacle connector members ae mated. A movable contact 34 is mounted in each of the openings 32.

Each contact 34 includes an elonated spring beam portion 36 which extends outwardly from the opening 32 and terminates in a contacting surface 38 facing in a direction to engage the contacting surface 28 on the corresponding contact 24 in the receptacle connector member 14. Each contact 34 has a rear wire termination portion 40. The contacting surfaces 38 on contacts 34 are adjacent to but laterally spaced from contacting surfaces 28 on contacts 24 when the connector members 12 and 14 are initially mated.

A pair of insulator actuating plates 42 are slidably mounted in the plug connector member in front of fixed insulator 30. Each plate is formed with a plurality of spaced apertures 44 through which the contact beams 36 extend. A projection 46 is formed on one wall of each aperture 44 engaging the beam portion 36 of the contact therein. Each projection engages it corresponding contact at a point spaced from the contacting surface 38 so that outward movement of the plates 42 will shift the contacting surfaces laterally outwardly to engage the mating contacting surfaces 28 on the corresponding contacts 24 in the connector member 14 when the two connector members are interengaged. As explained previously herein, such actuation of the spring beam portions of the contacts 34 produces a slight wiping action between the contacting surfaces 28 and 38 of the mating contacts.

A cam actuating shaft 50 is mounted in the plug connector member 12 between the plates 42 for rotation about a vertically extending axis which is parallel to the contacts 34 and thus perpendicular to the front face of the fixed insulator 30. Preferably the actuating shaft is centrally mounted in the plug connector member between the opposite ends thereof. A retaining bracket 52 is fixedly mounted in the insulator 30 in front of the plates 42 retaining the plates in the connector. The retaining bracket is formed with a central circular opening 54 which functions as a bearing for rotatably supporting the actuating shaft 50. The forward or upper end of the actuating shaft extends beyond the front face of the insulator 30. The shaft also extends rearwardly from the insulator. An actuating handle 56 is fixed to the rear of the shaft 50.

Figure 3:
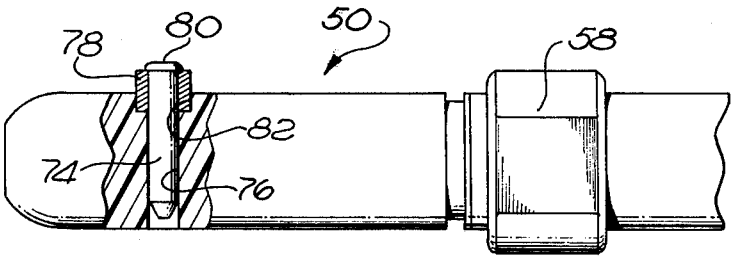
FIG. 3 is an enlarged, fragmentary, partial sectional view of the cam shaft employed in the plug connector member of FIG. 1.
Figure 4:
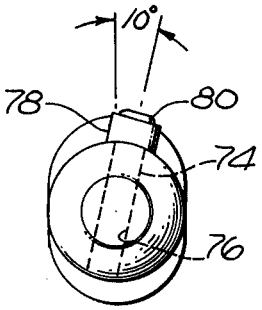
FIG. 4 is a front end view of the cam shaft illustrated in FIG. 3.

As best seen in FIGS. 3 and 4, the shaft 50 is formed with an integral, eccentric cam 58. The cam is positioned between a pair of cam bearings 60 located between the shaft and the inner surfaces of the actuating plates 42.

Figure 2:
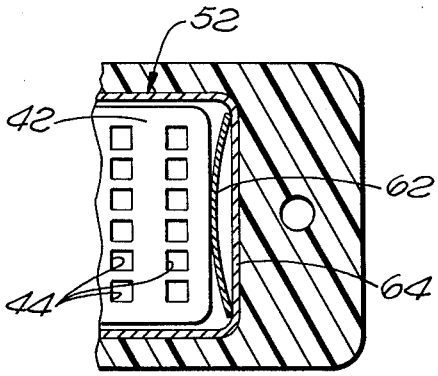
FIG. 2 is a transverse sectonal view taken along 2—2 of FIG. 1 showing the interior structure of one end of the plug connector member illustrated in FIG. 1.

A leaf spring 62 is positioned between a turned down edge 64 at each end of the retaining bracket 52 and the outer surface of the actuating plate 42 to bias the plate inwardly so that the cam bearing 60 is urged into engagement with the cam 58 on the shaft 50. See FIG. 2

The plates 42 are normally positioned such that the contacting surfaces 38 of the movable contacts 34 will be out of engagement with the contacting surfaces 28 of the fixed contacts 24. Thus, the connector members may be mated with zero insertion force. When the cam shaft 50 is rotated 100°, the plates 42 shift in opposite directions, thereby shifting the contact beams 36 of the contacts 34 in tandem so that the contacting surfaces 38 and 28 of the respective sets of contacts will engage each other with a high unit force of contact. When the shaft is returned to its normal position, the leaf springs 62 will return the plates 42 to the position shown in FIG. 1 and the two sets of contacts will disengage. The structure and operation of the connector 10 described so far is similar to that disclosed in the aforementioned Anhalt patent.

Figure 5:
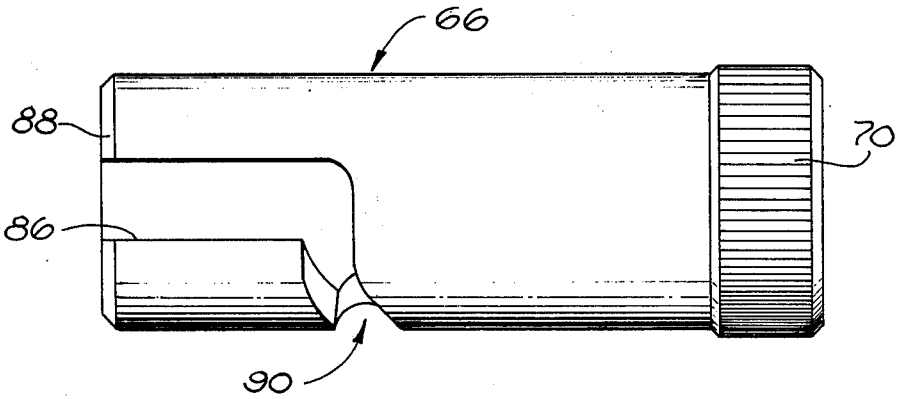
FIG. 5 is a side elevational view of the coupling bushing employed in the receptacle connector member illustrated in FIG. 1.

In accordance with the present invention, means is provided for producing greater sliding engagement between the contacting surfaces 28 and 38 of the contacts 24 and 34 than is produced by simply flexing of the spring beams 36 of contacts 34 to assure that a reliable electrical contact is made even in heavily contaminated environments, such as dust laden environments. To this end, a generally cylindrical coupling bushing 66 is fixedly mounted in a bore 68 extending lengthwise from its front face to the rear face of the insulator 20 and in axial alignment with the cam shaft 50 in the plug connector member 12. As best seen in FIG. 5, the rear end 70 of the bushing is slightly enlarged and knurled on its outer surface so that the bushing is frictionally retained in the opening 68. The forward end of the opening is chamfered, as indicated at 72, to provide a lead-in entrance for facilitating insertion of the forward end of the cam shaft 50 into the bushing 66.

As best seen in FIG. 3, a pin 74 is mounted in a laterally extending hole 76 in the forward end of the cam shaft 50. The pin has an interference fit with the hole. A metal sleee, or roller bearing, 78 is loosely mounted on the outer exposed end of the pin and retained thereon by a head 80 on the terminal end of the pin. The inner end of the sleeve 78 lies in a circular recess 82 formed in the surface of the cam shaft. The outer portion of this sleeve extends beyond the surface of the shaft providing a rotatable bearing.

As seen from FIG. 4, the pin 74 is offset 10° from a vertical line passing through the axis of the cam shaft. A key slot 84 is formed in the wall of the opening 68 in the insulator 20. An axially extended slot 86 is formed in the wall of the bushing 66 and opens at the forward end 88 thereof. The slot 86 is aligned with the key slot 84 and both are offset 10° in the same direction as the pin 74. Hence, when the connector members are initially mated, the sleeve or roller bearing 78 on the end of the pin 74 will slide rearwardly through the slots 84 and 86.

As best seen in FIG. 7, the bushing 66 is formed with a second slot generally designated 90, which extends laterally to and opens at the rear of the axially extending slot 86. The portion 92 of the slot 90 adjacent to slot 86 is perpendicular to the slot 86. The slot 90 is then inclined rearwardly at a slight angle, as indicated at 94 and then terminates in an outer section 96 which is perpendicular to the slot 86.

When the connector members are initially engaged, and the bearing 78 slides to the rear of the slot 86 in bushing 66, the contacting surfaces 28 and 38 of the contacts 24 and 34 of the respective connector halves are laterally adjacent to but spaced from each other so that the connector halves are mated with essentially zero force. To actuate the movable contacts 34 and thereby bring the contacting surfaces 28 and 38 of the contacts into engagement, the cam shaft 50 is rotated causing the pin 74 with the roller bearing 78 thereon to enter into the laterally extending slot 90 in bushing 66. As the roller bearing enters the perpendicular inner section 92 of slot 90, the cam 58 on the shaft commences outward movement of the actuating plates 42 in the plug connector member 12. Further rotation of the cam shaft causes the roller bearing to enter the annular section 94 of the slot 90. A camming action occurs between the roller bearing and the rearwardly facing surface 98 of the slot 94 (which functions as a cam ramp) causing the two connector members 12 and 14 to be drawn together, thus producing an axial wiping engagement between the contacting surfaces 28 and 38 of the contacts in the two connector members. Full rotation of the cam shaft 100° causes the roller bearing 78 to enter the outer section 96 of slot 90 whereupon the contacts are fully actuated. The final positioning of the roller bearing 78 in the perpendicular outer section 96 of slot 90 locks the two connector members 12 and 14 together. Thus, by the provision of the roller bearing 78 on pin 74 carried by the cam shaft 50, and the cam ramp 98 formed by the angular section 94 of slot 90 in bushing 66, not only are the contacting surfaces of the two sets of contacts in the connector members shifted laterally in tandem into engagement with each other, but also an axial shifting of the contacts is simultaneously produced, which greatly increases the wiping action between the contacts and thereby enhances the electrical engagement therebetween.

Reference is made to FIG. 8 which illustrates a modified configuration of the slot formed in the bushing 66. In this embodiment, the slot 86 is as previously described. However, the laterally extending slot 90 has a pair of angular slot sections 94a and 94b so that the slot 90 has a generally U-shaped configuration. By this arrangement, movement of the roller bearing 78 through the slot 90 will cause the contacting surfaces 28 and 38 of the contacts 24 and 34, respectively, to wipe back and forth, in opposite directions. Thus, as the contacting surfaces are wiped in a first direction, the surfaces therebetween are cleaned. Wiping action in the opposite direction results in the contacting surfaces being finally positioned in clean areas.

Although the present invention has been specifically described in connection with a zero insertion force connector of the general type disclosed in the aforementioned Anhalt patent, it will be appreciated that the basic principle of the invention, namely the axial wiping of contacts in a zero force connector, may be incorporated into other types of zero force connectors. For example, this feature may be incorporated into those types of zero force connectors in which one connector member is entirely shifted with respect to the mating connector member to bring the contacts into engagement by suitably modifying the actuating mechanism therefor. Thus, the scope of the present invention is not to be limited by the specific embodiments disclosed herein.

What is claimed is:

1. An electrical connector assembly comprising:

a first connector member having a first set of contacts therein;

a second connector member having a second set of contacts therein, each contact in said second set being associated with one of the contacts in said first set;

the associated contacts of said first and second sets of contacts being positioned laterally adjacent to but spaced from each other when said connector members are mated;

first means for laterally moving said first set of contacts to engage said second set of contacts;

second means for shifting said first and second connector members axially relative to each other to cause an axial wiping engagement between the associated contacts of said first and second sets of contacts, operation of said second means drawing said connector members together.

2. An electrical connector assembly comprising:

a first connector member having a first set of contacts therein;

a second connector member having a second set of contacts therein, each contact in said second set being associated with one of the contacts in said first set;

the associated contacts of said first and second sets of contacts being positioned laterally adjacent to but spaced from each other when said connector members are mated;

first means for laterally moving said first set of contacts to engage said second set of contacts;

second means for shifting said first and second connector members axially relative to each other to cause an axial wiping engagement between the associated contacts of said first and second set of contacts; and said first means including an actuating plate in said first connector member movable laterally relative to the axes of said contacts of said first set, and a rotatable cam shaft engaging said plate, rotation of said shaft causing said actuating plate to shift laterally to move said first set of contacts in said first connector member.

3. An electrical connector assembly as set forth in claim 2 wherein: said second means includes said cam shaft.

4. An electrical connector assembly as set forth in claim 2 wherein:

said cam shaft is carried by said first connector member and extends in a direction parallel to the axes of said contacts, the forward end of said shaft extending forwardly of said first connector members and carrying a laterally extending pin;

an opening in said second connector members receiving said forward end of said shaft when said connector members are mated;

an axially extending slot in said opening for slidably receiving aid pin; and a rearwardly facing surface in said opening communicating with one side of said slot, said pin engaging behind said surface to lock said connector members together when said cam shaft is rotated to actuate said first set of contacts.

5. An electrical connector assembly as set forth in claim 4 wherein: said rearwardly facing surface includes an inclined ramp, said pin and ramp cooperating to shift said connector members axially upon actuation of said first set of contacts by rotation of said cam shaft, said cam shaft, pin and inclined ramp forming said second means.

6. An electrical connector assembly as set forth in claim 5 wherein: said ramp is provided by a second slot in said opening, said second slot opening laterally into said axially extending slot.

7. An electrical connector assembly as set forth in claim 6 including:

a hollow metal bushing mounted in said second connector member coaxial with said cam shaft, the interior of said bushing forming said opening; and said slots being formed in the wall of said bushing.

8. An electrical connector assembly comprising:

a first connector member having a plurality of contacts, each contact having a contacting surface and being secured in individual bores in said first connector member;

a second connector member having a plurality of contacts, each of said second connector member contacts being secured to indvidual bores in said second connector member and having a contacting surface extending from said bores;

each of said contacts in said second connector member being associated with a contact in said first connector member and being spaced laterally apart from said associated contact when said connector members are mated;

actuating means including a rotatable cam shaft for laterally moving said plurality of contacts in one of said connector members causing said first connector member contacting surfaces to mate with said second connector member contacting surfaces after said first connector member is secured to said second connector member; and said actuating means including means cooperating with said cam shaft for shifting said first and second connector members axially relative to each other to cause an axial wiping engagement between contacts upon actuation of said one connector member contacts.

* * * * *